US011840431B2

(12) United States Patent
Felps et al.

(10) Patent No.: US 11,840,431 B2
(45) Date of Patent: Dec. 12, 2023

(54) ELECTRONIC WINCH AND WINCH CONTROL

(71) Applicant: MotoAlliance, Inc., Rogers, MN (US)

(72) Inventors: Jimmie Doyle Felps, Colorado Springs, CO (US); Scott Charles Heupel, Maple Grove, MN (US)

(73) Assignee: MotoAlliance, Excelsior, MN (US)

( * ) Notice: Subject to any disclaimer, the term of this patent is extended or adjusted under 35 U.S.C. 154(b) by 0 days.

(21) Appl. No.: 16/435,841

(22) Filed: Jun. 10, 2019

(65) Prior Publication Data

US 2019/0292026 A1 Sep. 26, 2019

Related U.S. Application Data

(63) Continuation-in-part of application No. 15/863,273, filed on Jan. 5, 2018, now Pat. No. 10,343,879.

(51) Int. Cl.
*B66D 1/48* (2006.01)

(52) U.S. Cl.
CPC ..... *B66D 1/485* (2013.01)

(58) Field of Classification Search
CPC ..... B66D 1/485
USPC ..... 318/10
See application file for complete search history.

(56) References Cited

U.S. PATENT DOCUMENTS 4,546,391 A * 10/1985 Kimura ..... H04N 1/32117 358/909.1
6,396,230 B1 * 5/2002 Lauk ..... B60S 1/08 318/443
2003/0128002 A1 * 7/2003 Kokubo ..... B41J 19/202 318/268
2011/0104963 A1 * 5/2011 Ellis ..... G05D 1/0206 440/6
2014/0205340 A1 * 7/2014 Yamaguchi ..... H04N 1/00652 399/396
2016/0251794 A1 * 9/2016 Kim ..... D06F 37/304 8/137
2018/0106105 A1 * 4/2018 Anthony ..... H02P 7/03
2018/0244507 A1 * 8/2018 Haley ..... B66D 1/30
2019/0217836 A1 * 7/2019 Bast ..... B60T 13/741
2019/0284028 A1 * 9/2019 Matsushita ..... B66D 5/26

OTHER PUBLICATIONS

DE 102010027650 A1 (Mar. 10, 2011) Powered Tool Lau James Ching-Sik Jin Chang Lin (Year: 2011).*

* cited by examiner

*Primary Examiner* — Jorge L Carrasquillo
(74) *Attorney, Agent, or Firm* — The Neudeck Law Firm, LLC

(57) ABSTRACT

A winch control system having a solid state winch contactor and a boost power supply for a vehicle equipped with an electric winch and especially for off-road vehicles, is disclosed. This invention automatically provides three winch speeds: a "slow start" ("creep") speed for "parking" the hook and for "sneaking" up on a load, a normal speed for normal winch operation and a fast speed for taking less time to unwind and rewind the winch rope when there is no load on the winch. Protection features for the winch contactor and/or the winch include, but are not limited to, electronic winch motor braking, current limiting, over temperature, undervoltage and reverse battery. Winch current limiting is adjustable from 100 amps to 300 amps, chosen for the purpose of accommodating various winch sizes.

20 Claims, 10 Drawing Sheets

ELECTRONIC WINCH AND WINCH CONTROL

TECHNICAL BACKGROUND

Electric winches have long been used, especially on utility type, off-road vehicles, for various pulling and lifting tasks. The first shortcoming of prior art has been the personal danger and possibility of winch damage when trying to "park" the winch hook and the inability to "sneak" up on a load. A second shortcoming is the length of time it takes to unwind and rewind the winch rope when there is no load. A third shortcoming is the risk of tangling the winch rope when winching a vehicle that is stuck and suddenly gets traction, causing sudden slack in the winch rope. A fourth shortcoming is the lack of adequate protection features and reliability for the winch motor and/or the electro-mechanical relay control module (i.e. contactor) that powers the winch motor and also reverses the direction of the winch drum. This invention overcomes the first shortcoming by employing a "slow start" mode (or "creep" mode) which automatically switches to a normal winch speed after a short period of time. The second shortcoming is overcome by detecting when the winch is unloaded and after a pre-determined period of time automatically switching to a faster rope speed (boost mode). The third shortcoming is overcome by the fast speed that minimizes the risk of getting a loose rope. The fourth shortcoming is minimized by the many features employed in this invention which include over-current-protection, current-range-adjustment, over-temperature-protection, various protection modes for the external drive, metal oxide semiconductor field effect transistors (MOSFETs), low-battery-protection and reverse-battery-protection.

Prior art to offer multiple winch speeds has been done by changing gear ratios (in the winch gear box) by U.S. Pat. No. 5,927,691 (Otteman), U.S. Pat. No. 4,453,430 (Sell) and U.S. Pat. No. 4,161,126 (Winzeler). Changing gear ratios has a disadvantage because it increases the winch torque by the same ratio as the gear ratio increase, resulting in an increased risk of personal injury and/or winch system damage. One with ordinary skill in the art will readily recognize how gearing affects winch load rating as demonstrated when using a "snatch block" where the winch rope is doubled between the load and the winch. This will cut the retrieval speed in half but also doubles the winch power (e.g. you get approximately 10,000 pounds of pull from a 5,000 pound winch).

Another method to offer multiple winch speeds is by using multiple stator windings with different numbers of poles in an alternating current (AC) motor as used in a shop winch in U.S. Pat. No. 4,145,645 (Price, et al.). This approach is a result of recognizing the benefits of having multiple winch speeds, especially a "creep" mode, but is not automatic and is not practical for a vehicle winch because AC voltage is not typically available. Trolling motors used for fishing have multiple speeds to allow a fisherman to change the speed of the boat. An early method of accomplishing this was to have up to five discrete speeds by using multiple windings and resistors in the winch motor which were selected by switches. More recent trolling motors use pulse-width-modulation (PWM) to power the motor. PWM is the use of a rectangular waveform where battery power is applied to the trolling motor for a period of time and then removed for the balance of the waveform cycle. The duty cycle of this PWM waveform is varied to achieve different motor speeds. Prior art trolling motor speed control is practical but complex, expensive and more difficult to accomplish at the high currents (up to 300 amps and more) required to drive a winch motor.

Yet another prior art that has been used to increase the speed of direct current (DC) motor is to simply apply a higher DC voltage to the motor winding. Such was a common practice in converting antique tractors or other antique vehicles from 6 volt electrical systems to 12 volt electrical systems. The 6 volt starter motor was seldom rewound for 12 volts. It would simply run faster on 12 volts because of the higher torque (since the torque of a DC motor is directly proportional to the motor's armature current), and consequently, make it easier to start the vehicle's engine. This approach is used in the present invention and automatically controlled.

One prior art, U.S. Pat. No. 8,958,956 (Felps) uses electronic control (i.e. solid state) for driving a vehicle winch but has only one winch speed and still uses an electro-mechanical contactor for energizing the winch and reversing the drum direction.

OVERVIEW

Exemplary embodiments described herein includes an electronic winch that includes a winch motor and control circuitry. The control circuitry is coupled to the winch motor and configured to, after receiving a first activation signal, control the winch motor to provide a first speed for a first period of time after receiving the first activation signal, the control circuitry also configured to control the winch motor to provide a second speed after the first period of time.

Another exemplary embodiment described herein includes an electronic winch, comprising a winch motor, control circuitry, and a housing that encloses the winch motor and the control circuitry. The control circuitry is coupled to the winch motor and configured to, after receiving a first activation signal, control the winch motor to provide a first speed for a first period of time after receiving the first activation signal, the control circuitry also configured to control the winch motor to provide a second speed after the first period of time.

Another exemplary embodiment described herein includes an integrated winch motor assembly that includes a winch motor, winch motor power control circuitry, control circuitry, and a housing. The motor power control circuitry is coupled to the winch motor. The control circuitry is coupled to control the motor power control circuitry and configured to, after receiving a first activation signal, control the motor power control circuitry to control the winch motor to provide a first speed for a first period of time after receiving the first activation signal, the control circuitry also configured to control the power control circuitry to control the winch motor to provide a second speed after the first period of time. The housing, which comprises at least two parts, is configured to protect the winch motor, the winch motor control circuitry, and the control circuitry from water intrusion.

BRIEF DESCRIPTION OF THE DRAWINGS

The drawings presented in the present disclosure provide a better understanding of the present invention, but are not intended to limit the scope or use of the invention. The components in the drawings do not necessarily adhere to conventional symbols, emphasis being placed upon clearly illustrating the principles of the present invention. Some components such as capacitors and transient voltage surge protectors used for filtering and/or voltage surge protection are not shown since they are not pertinent to understanding the operation of the invention. Moreover, in the drawings, a tilde character (~), indicates a "not true" polarity of a logic signal. Like reference numerals designate corresponding parts throughout the several views and in which.

DETAILED DESCRIPTION OF THE EMBODIMENTS

Figure 1:
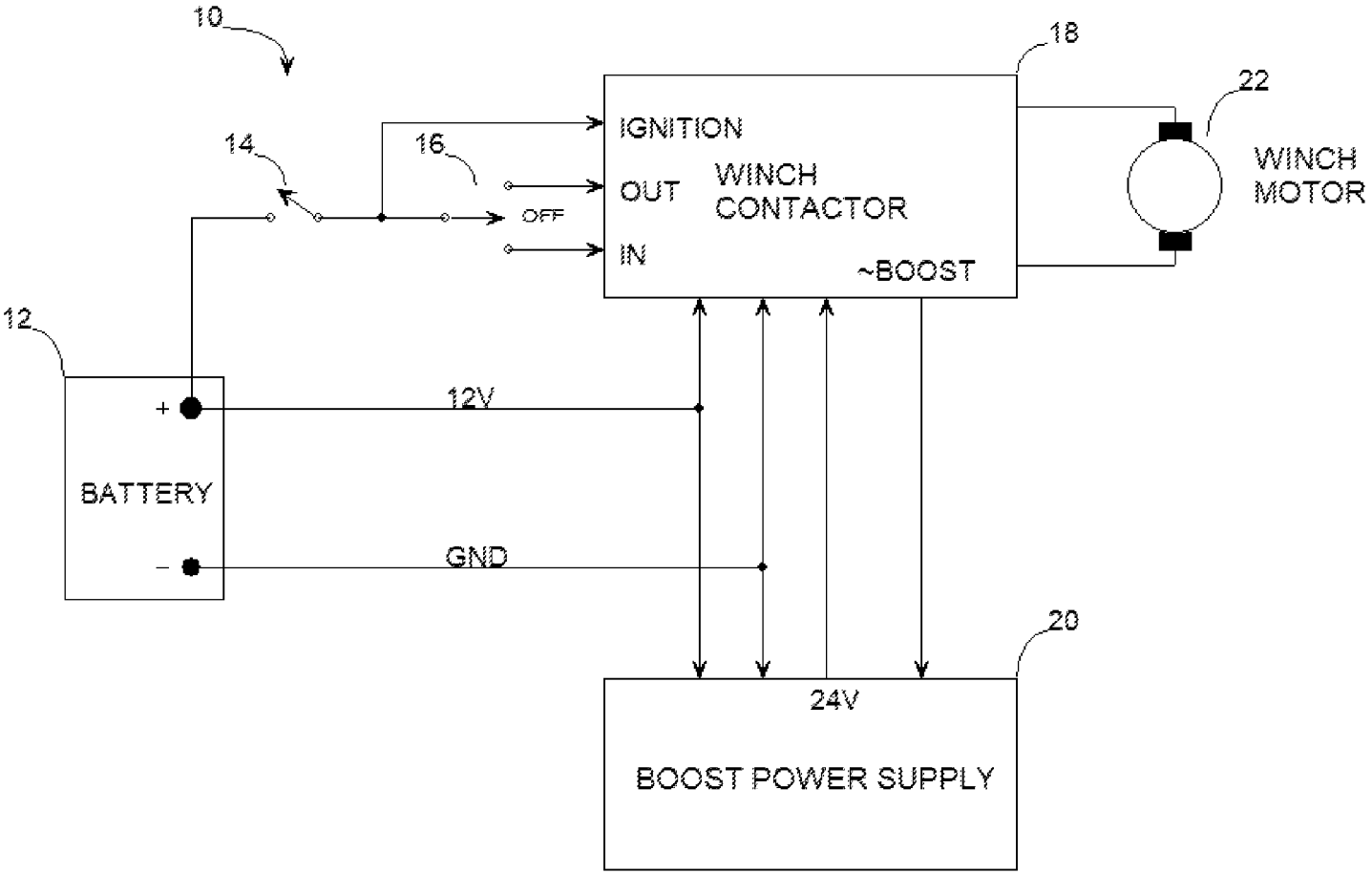
FIG. 1 is a simplified schematic of a typical vehicle electrical system equipped with an electric winch that is being driven by a preferred embodiment of the present invention comprising a solid state winch contactor and a boost power supply.

In an embodiment, when a winch is activated via an IN or OUT signal, a low duty cycle pulse-width-modulated (PWM) waveform powers the winch motor for 650 milliseconds to provide a "slow start" mode before switching to a continuous 12 volt mode for normal operation. If the IN/OUT switch is cycled before the low duty cycle PWM waveform ends, slow start will repeat. If IN or OUT is initiated and if no load has been detected on the winch for 1.5 seconds, the winch motor drive voltage of 12 volts is boosted to 24 volts to increase the winch drum speed. When the winch is running in the fast speed mode and a load is suddenly detected on the winch, the boost power supply is immediately turned off.

By using a 20% duty cycle, 9.5 kHz drive waveform to produce slow start, the winch torque is reduced from what it is during the normal speed because the winch motor's armature current is decreased. In practice (i.e. using this slow start drive on a MotoAlliance 12 volt Viper Elite 5000 pound electric winch on its outer layer of winch rope), the armature current for slow start is typically 6.76 times lower than normal speed, resulting in a typical reduction of winch load rating from 5000 pounds to 740 pounds. Not only does this greatly reduce risk of personal injury or damage to the winch system, but also makes it easy to stall the winch when parking the hook or sneaking up on a load, and resulting in no undue stress on the winch rope. On the outer layer of the winch rope, typical winch rope speeds observed was 0.85 inches per second for slow speed, 6.6 inches per second for normal speed and 10.5 inches per second for fast speed.

If desired, the present invention can also be used without the boost feature, eliminating the need for the boost power supply. Eliminating the boost feature also allows the winch contactor to be used with 24 volt vehicle electrical systems.

The motor driver integrated circuit (IC), DRV8701E, used to drive the winch motor provides electronic braking by shorting the winch motor winding as soon as IN or OUT is terminated. Protection features in the winch contactor protect it, and indirectly, protect the winch against over-current and over-temperature. Reverse battery protection prevents damage to the solid state winch contactor in the event the battery connections are reversed.

The present disclosure describes how this preferred embodiment of the present invention operates, but is not intended to limit the scope, other applications or uses of the present invention. The present disclosure is primarily for off-road vehicles, but is not limited to these vehicles, nor limited in its chosen signal timings for various features or limited in its chosen output current or voltage capabilities. All logic circuit timings and duty cycle percentages, circuit voltages and temperatures are approximate.

To begin, refer to FIG. 1, a block diagram for the portion of a vehicle's electrical system required when a winch control system using the present invention has been added. Battery 12 is the vehicle battery which is typically a flooded, lead-acid battery; switch 14 is part of the vehicle's ignition switch and is wired to enable winch operation only when the ignition switch is on; switch 16 is a winch control switch with a center off position and momentary positions for IN and OUT; winch contactor 18 is a solid state winch controller that provides functions necessary to drive and protect winch motor 22; and when winch motor 22 is unloaded, boost power supply 20 boosts winch contactor 18 motor voltage from 12 volts to a regulated 24 volts for driving winch motor 22 at a faster speed.

In the present invention an output current of 40 amps was chosen for boost power supply 20 which is sufficient for many unloaded, winch motors 22, especially those having load ratings up to 5000 or 6000 pounds. Lower output currents as well as higher output currents for boost power supply 20 may apply to other winch motor 22 sizes and/or brands. Winch contactor 18 and boost power supply 20 should be waterproof units to withstand the elements of nature.

Figure 2A:
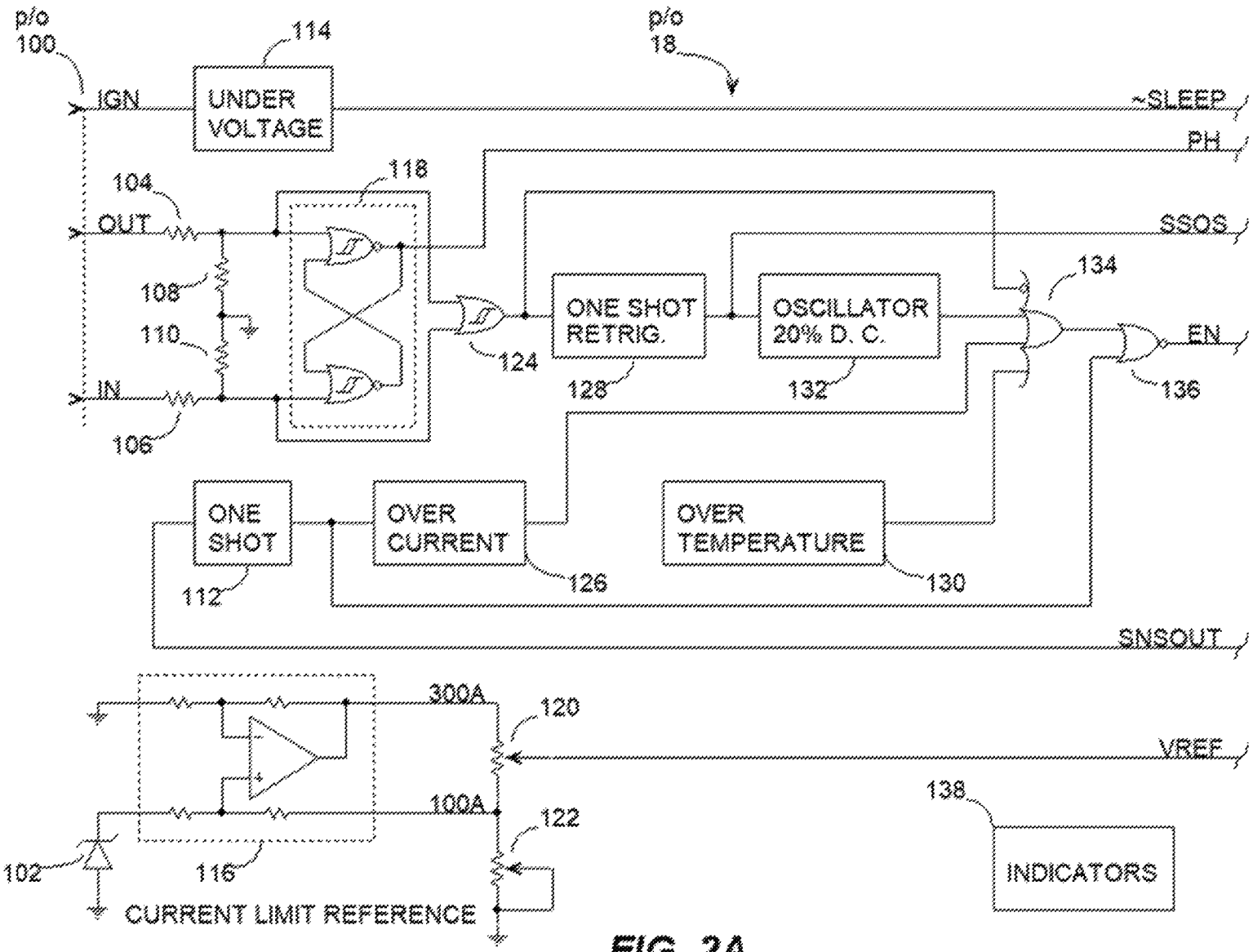
FIG. 2A is a schematic of the driver control for winch contactor 18 in FIG. 1 (100 series numbering)
Figure 2B:
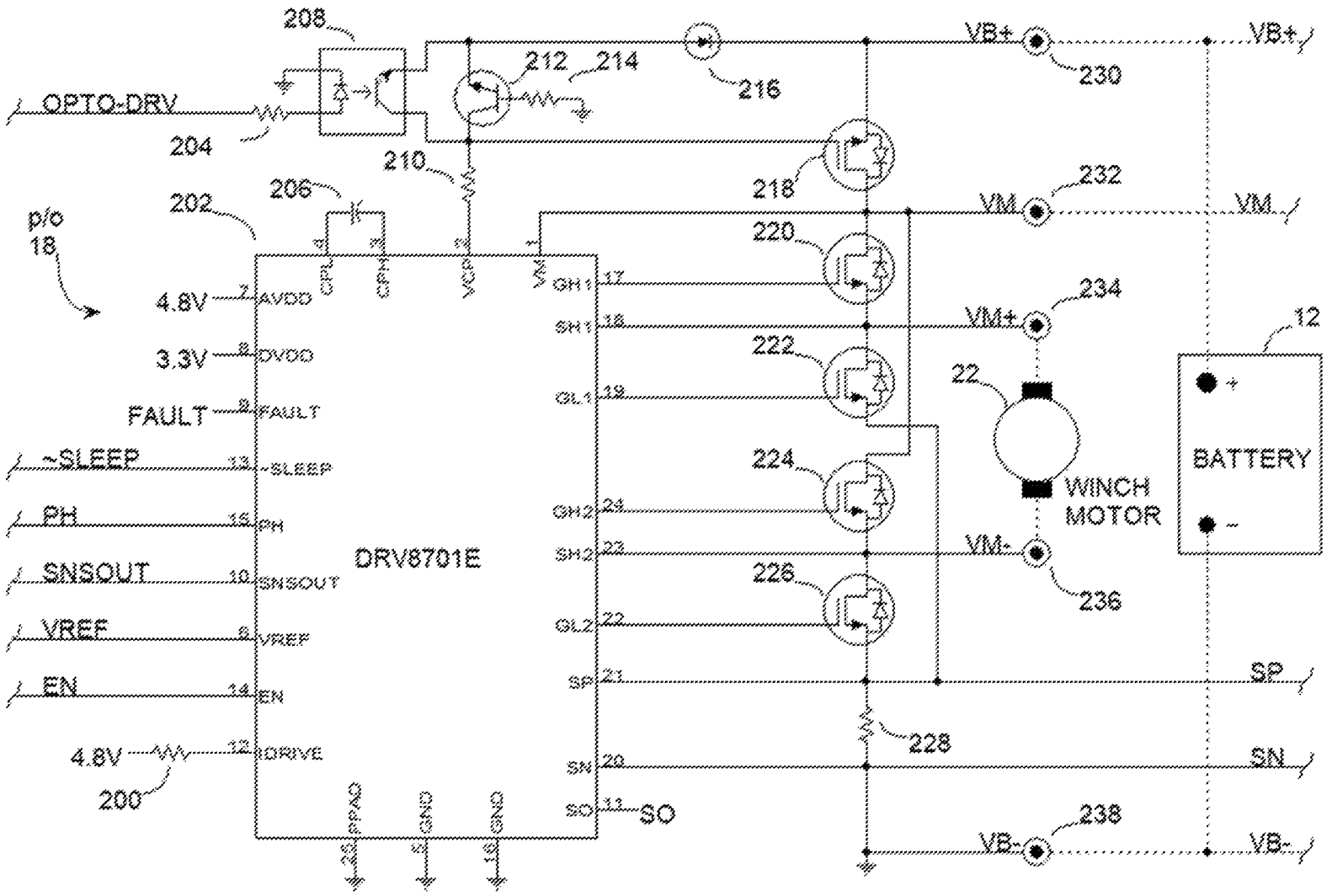
FIG. 2B is a schematic of the motor driver for winch contactor 18 in FIG. 1 (200 series numbering) being simplified by showing MOSFETs 218-226 and resistor 228 as single devices when in fact they are multiple devices in parallel.
Figure 2C:
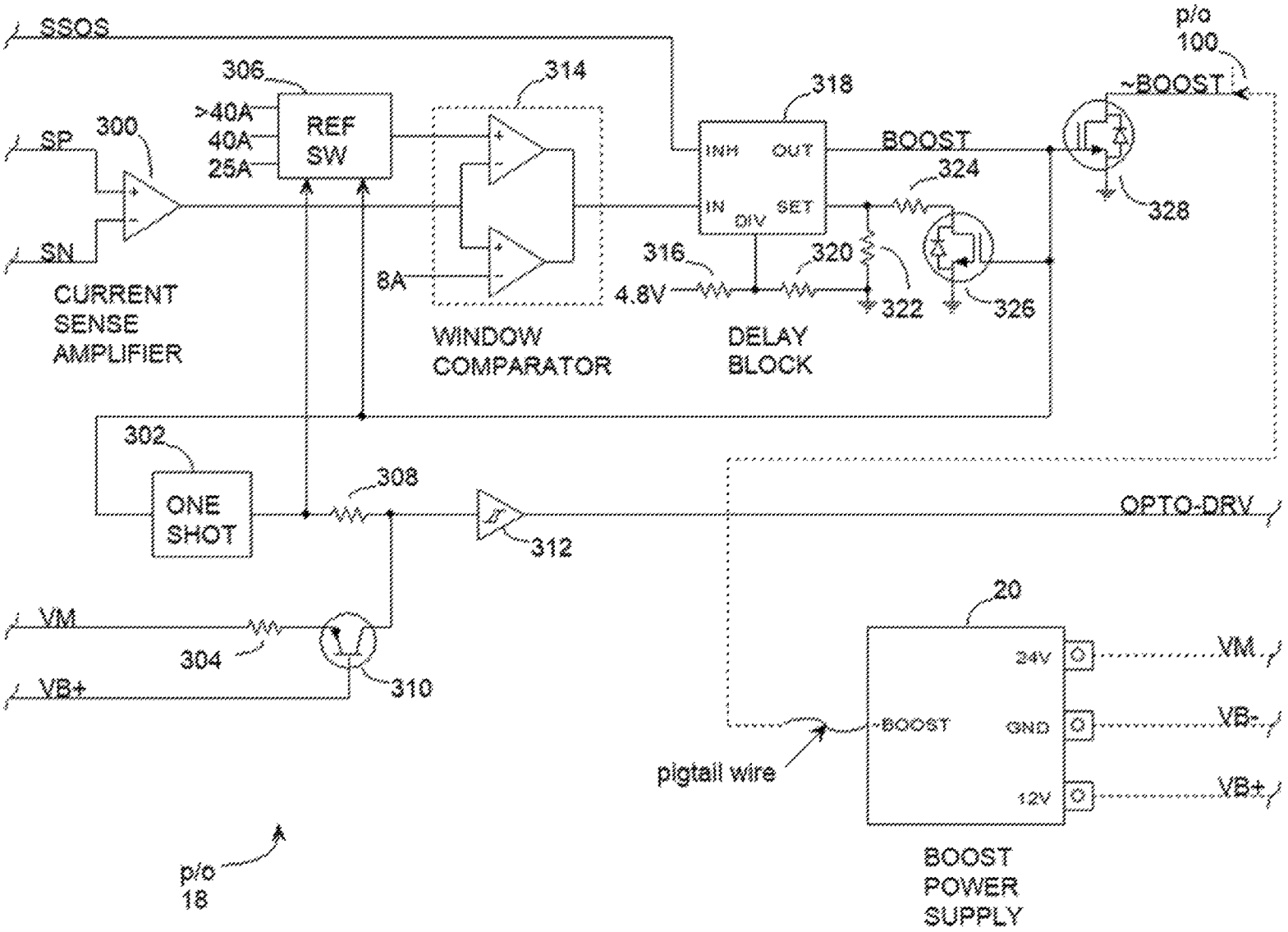
FIG. 2C is a schematic of the boost control for winch contactor 18 in FIG. 1 (300 series numbering).

Referring to FIGS. 2A, 2B and 2C, driver control, motor driver and boost control, respectively, these three schematics combine to perform the functions of winch contactor 18. Part of connector 100 in FIG. 2A (three terminals) provides the interface for IGN (ignition), IN and OUT signals from switches 14 and 16 in FIG. 1. The other part of connector 100 in FIG. 2C (one terminal) provides an output, BOOST, to activate boost power supply 20 in FIG. 2C.

Referring to FIG. 2A (driver control), under voltage 114 activates integrated circuit (IC) DRV8701E 202 in FIG. 2B via the SLEEP signal and lights the ON light-emitting-diode (LED) (green) in indicators 138, provided battery 12 voltage in FIGS. 1 and 2B is above 8 volts. If the voltage is below 8 volts or switch 14 in FIG. 1 is off, no LEDs will be lit in indicators 138. Resistors 108 and 110 are pull-down resistors for when IN or OUT is not selected. Resistors 104 and 106 limit the current into latch 118 and OR gate 124. Latch 118 selects the phase, PH, of the drive to winch motor 22 in FIG. 2B through IC DRV8701E 202 in FIG. 2B. OR gate 124 triggers one shot 128 when IN or OUT is selected. Latch 118 and OR gate 124 have Schmitt trigger inputs for slow rise and fall times. Latch 118 also debounces the IN and OUT signals.

One shot 128 has a pulse width of 650 milliseconds. When one shot 128 is triggered, oscillator 132 begins to oscillate at 9.5 kHz with a typical 20% duty cycle (percentage of low level time). The low oscillator frequency of 9.5 kHz was chosen because of the large, power MOSFETs 220-226 in FIG. 2B. The output of OR gate 134 (having one inverted input) has to be low to drive winch motor 22 in FIGS. 1 and 2B. If the other inputs to OR gate 134 and NOR gate 136 allow oscillator 132 to determine the enable signal, EN, the signal EN will be high for 20% of its period, generating a slow start drive for winch motor 22. When EN is high the IN/OUT LED (orange) in indicators 138 is lit, but is dim during slow start. Each time IN or OUT is selected, the complete 650 millisecond period occurs at one shot 128 even if one shot 128 has not previously timed out (i.e. retriggerable). This feature is especially useful when parking the hook because it allows an extended slow start.

SNSOUT is a signal from IC DRV8701E 202 that occurs when an over current event occurs on winch motor 22 which results in winch motor 22 no longer being driven and the IN/OUT LED (orange) in indicators 138 is no longer lit. SNSOUT is generated as a means of current regulation for winch motor 22 referred to as "current chopping," which is a "fixed-off-time" regulation scheme with a variable time to be on and to stay on until current chopping occurs again. Again, because of large, power MOSFETs 220-226, this off time pulse needed to be increased from its 25 microseconds. One shot 112 pulse width was chosen to be 100 microseconds. One shot 112 extends the off time of winch motor 22 through an input in NOR gate 136.

Even though IC DRV8701E 202 and one shot 112 combine to provide current regulation for winch motor 22, the rate at which current chopping occurs is a function of how much current overload exists in winch motor 22. If current chopping is occurring more frequently than every 3 milliseconds, over current 126 will shut down drive to winch motor 22 through an input of OR gate 134 for a period of 5 seconds and lights the over current LED (blue) in indicators 138. Over current shutdown can occur in less than 100 milliseconds for very high, current overloads.

Over temperature 130 senses the temperature of MOSFET 226 in FIG. 2B (which is on during an IN operation and at which time winch motor 22 can be heavily loaded) and shuts down drive to winch motor 22 when the temperature reaches 85° C. Shutdown lasts 14 seconds to allow cool down of MOSFETs 218, 220 and 226. This event lights over temperature LED (red) in indicators 138. All protection shutdown modes for winch motor 22 last sufficiently long to alert the operator that a protection feature has taken over control of winch motor 22.

Reference voltage 102 provides a 2.5 volt reference for differential amplifier 116 that has a gain of 0.2. The result is a VREF that ranges from 750 millivolts (300 amp upper current limit for winch contactor 18) at the top of potentiometer 120 and 250 millivolts (100 amp lower current limit) at the bottom, plus an offset voltage of up to 330 millivolts (130 millivolts typically) set by potentiometer 122 to compensate for output offset voltage of the current sense amplifier output signal, SO, in IC DRV8701E 202 when IN or OUT is not activated.

Referring to FIG. 2B (motor driver), IC DRV8701E 202 contains a charge pump to create charge pump voltage, VCP, which is typically 9.5 volts above winch motor supply voltage, VM, so N-channel, enhancement mode, MOSFETs 220 and 224 could be used. The charge pump in IC DRV8701E 202 can deliver only enough current to support MOSFETs 220 and 224 that have a maximum total gate charge, Qg, of 200 nanocoulombs at 38 kHz. Therefore, the timing on oscillator 132 and one shot 112 in FIG. 2A was chosen to be compatible with the chosen MOSFETs 220 and 224 that have a maximum Qg of 578 nanocoulombs. And, the programming resistor 200 on IC DRV8701E 202 for DRIVE was chosen to be the maximum rating of 150 milliamps for high-side MOSFETs 220 and 224 and 300 milliamps for low-side MOSFETs 222 and 226. Capacitor 206 is the charge pump capacitor. Charge pump voltage, VCP, is also used to provide gate bias voltage for MOSFET 218.

Many protection features are included in IC DRV8701E 202 for MOSFETs 220-226 including excessive drain-to-source voltage (an indication of excessive drain current), undervoltage for motor supply voltage, VM, undervoltage for charge pump voltage, VCP, winch motor 22 current limiting, and delays for turning high side MOSFETs 220 and 224 on only after low side MOSFETs 222 and 226, respectively, have turned off, and vice versa. When MOSFETs 220 and 226 are on, the voltage at VM+ terminal 234 is positive and the voltage at VM− terminal 236 is negative and winch motor 22 is in the rewind mode, IN. And vice versa, when MOSFETs 224 and 222 are on, the voltage at VM+ terminal 234 is negative and the voltage at VM− terminal 236 is positive and winch motor 22 is in the unwind mode, OUT. The positive voltage, VB+, from battery 12 goes through reverse-battery-protection MOSFET 218 before supplying power to IC DRV8701E 202. If when installing battery 12 in the vehicle, the positive terminal of battery 12 is connected to VB− terminal 236 (ground) and the negative terminal of battery 12 is connected to the VB+ terminal 230, the reverse-battery-protection circuit consisting of diode 216, NPN transistor 212 and resistors 210 and 214 will turn MOSFET 218 off and not allow the voltage on VM terminal 234 to be negative with respect to VB− terminal 238 and lights a reverse-battery-protection LED (red) in indicators 138 in FIG. 2A. During this event no other LEDs in indicators 138 are lit. Boost power supply 20 in FIG. 2C must also have reverse-battery-protection to prevent damage to boost power supply 20 and possibly to winch contactor 18 in FIG. 1 via the VM terminal 232. If boost power supply 20 does not have reverse battery protection, then boost power supply 20 must be disconnected from the vehicle electrical system 10 in FIG. 1 until battery 12 is installed correctly as determined by winch contactor 18.

Resistor 204 and opto-coupler 208 can also turn MOSFET 218 off (via OPTO-DRV) to allow voltage, VM, to be boosted to 24 volts by boost power supply 20.

Resistor 228 senses current of winch motor 22 for the purpose of over-current-protection performed by IC DRV8701E 202 and for determining (via boost control circuitry in FIG. 2C) when winch motor 22 is unloaded.

Output voltage, 4.8V, from IC DRV8701E 202 provides power for winch contactor 18 in FIGS. 2A-2C. Output voltage, 3.3V, from IC DRV8701E 202 is only used to power the fault LED (red) in indicators 138, the FAULT signal being an output of IC DRV8701E 202, being low active during any of the many protection features built into IC DRV8701E 202 and recovering automatically when the fault ceases.

Referring to FIG. 2C (boost control), current sense amplifier 300 monitors the voltage across resistor 228 in FIG. 2B (SP minus SN), and amplifies it by a factor of 500 and sends the result to window comparator 314 which determines if the result lies between the range of 8 amps and 25 amps (the current range selected before boost). The output of window comparator 314 goes to digital delay block 318 where the output, BOOST, does not go high until window comparator 314 output remains high continuously for 1.5 seconds (set by resistor 322 and two programming resistors 316 and 320 for delay block 318). Slow start one shot 128 in FIG. 2A sends signal, SSOS, to delay block 318 input, INH, which inhibits the 1.5 second timing of delay block 318 until slow start ends. When the output of delay block 318, BOOST, goes high, it goes to MOSFET 328 which generates signal, BOOST, to turn on boost power supply 20, selects the 40 A current threshold in reference switch 306 (provided it is not over-ridden by one shot 302) and triggers one shot 302.

The pulse width of one shot 302 is 550 milliseconds for the purpose of essentially disabling the upper reference current for reference switch 306 (i.e. making it >40 A to allow the startup surge current in winch motor 22) and for turning off the reverse-battery-protection MOSFET 218 in FIG. 2B via output, OPTO-DRV, through resistor 308 and buffer 312. The pulse from one shot 302 allows time for PNP transistor 310 to detect motor voltage, VM, has become 1.0 volt higher than battery voltage, VB+ in FIG. 2B, and thus allows boost to continue after one shot 302 times out. Transistor 310 also prevents MOSFET 218 from being turned on again until motor voltage, VM, drops back down to within 1.0 volt of battery voltage, VB+. This prevents MOSFET 218 from having to discharge the output capacitors in boost power supply 20 when it has a high drain-to-source voltage (up to 16 volts) on it which would likely exceed the pulse power capability of MOSFET 218.

Resistor 304 limits the current through the base of transistor 310 and into the input of buffer 312. When one shot 302 times out, the signal, BOOST, switches reference switch 306 to select the 40 amp upper reference current for window comparator 314. This higher reference current (40 A versus 25 A) is for the purpose of allowing a higher winch motor 22 current that results when 24 volts is applied to winch motor 22. BOOST going high also switches in resistor 324 via MOSFET 326 to reduce the delay time to turn off delay block 318 to <300 milliseconds.

Figure 3A:
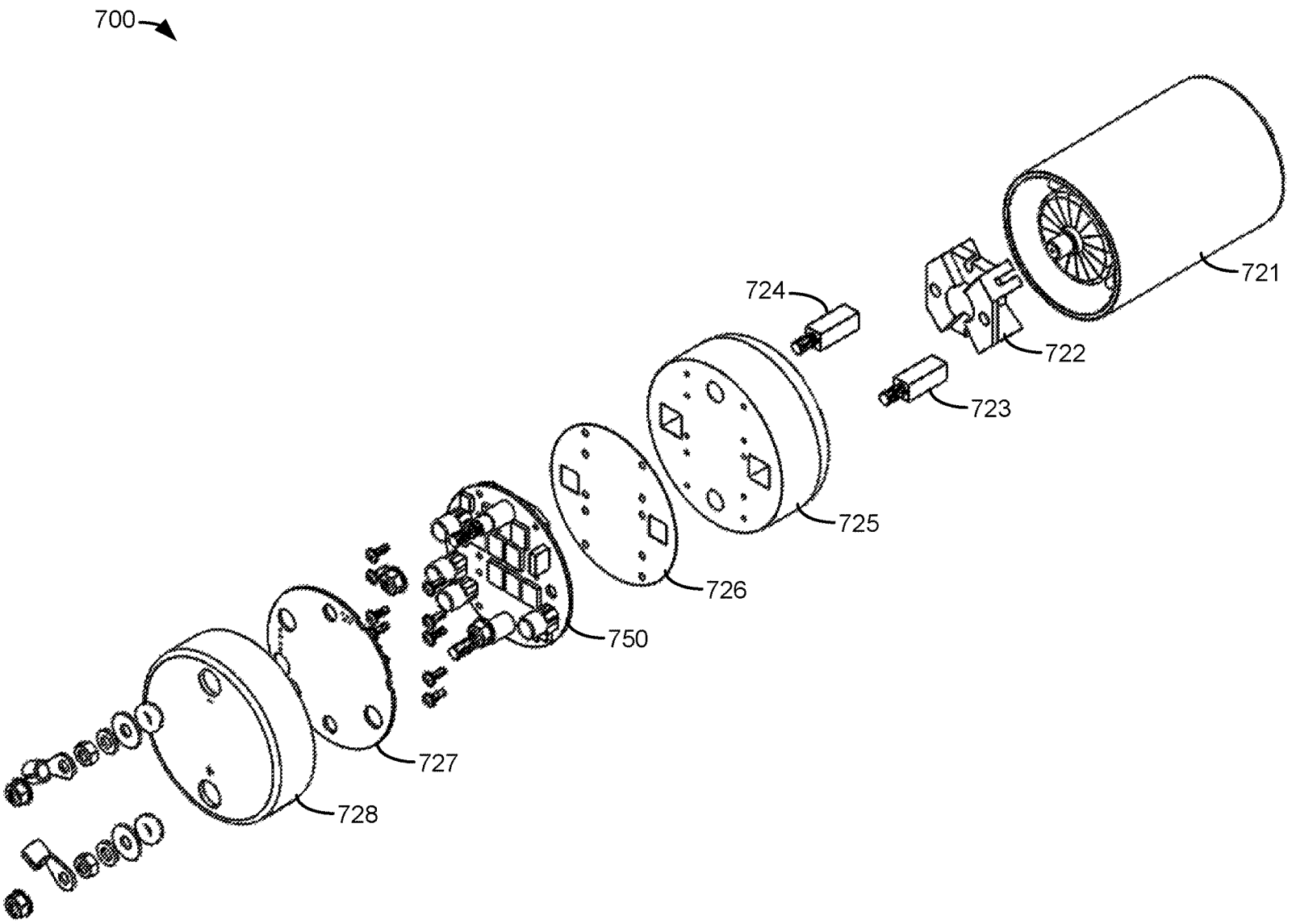
FIG. 3A is an exploded view illustrating an example integrated solid state winch control and winch motor assembly.
Figure 3B:
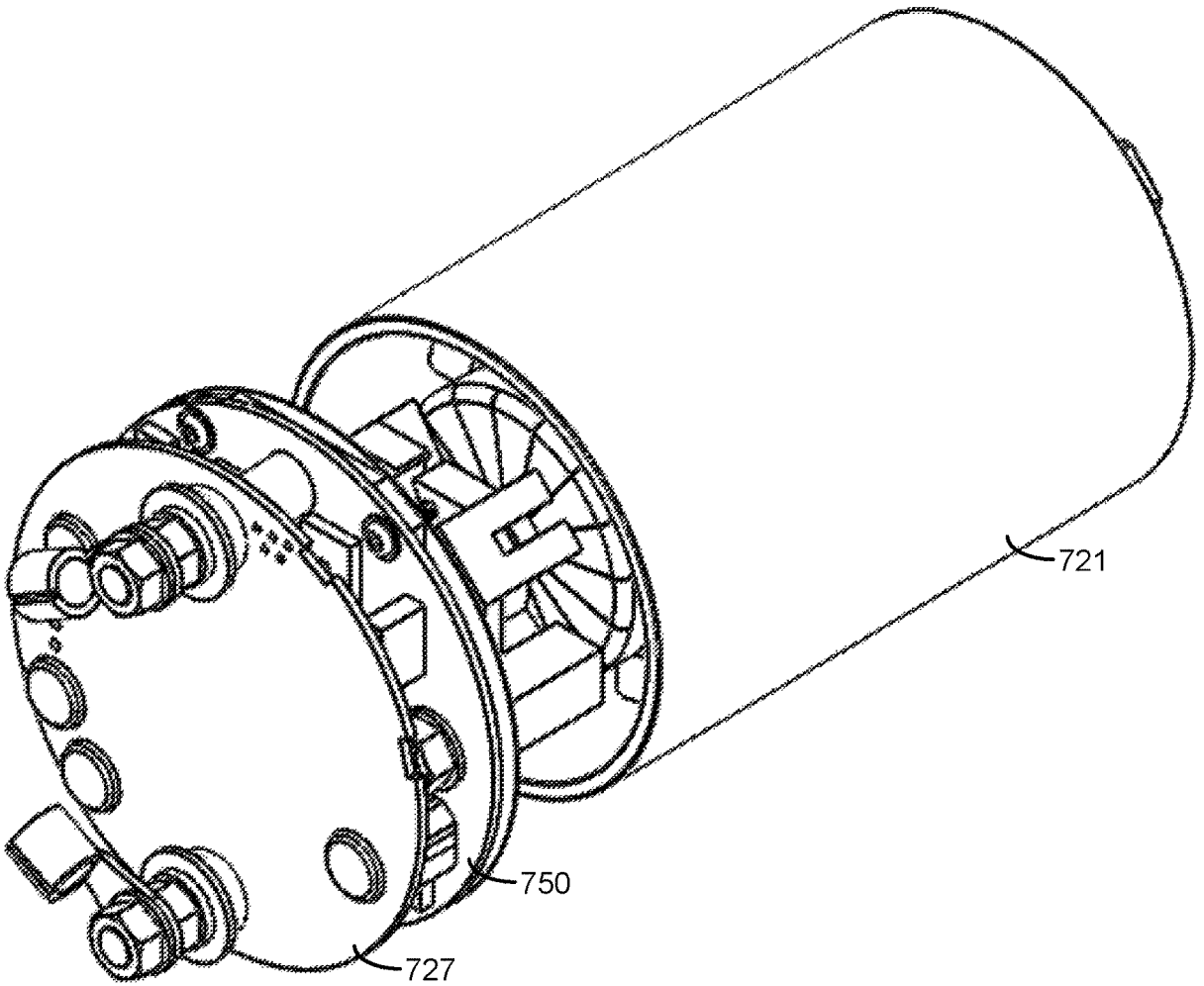
FIG. 3B is a partially exploded view illustrating the mating of an example integrated solid state winch control and winch motor assembly.
Figure 3C:
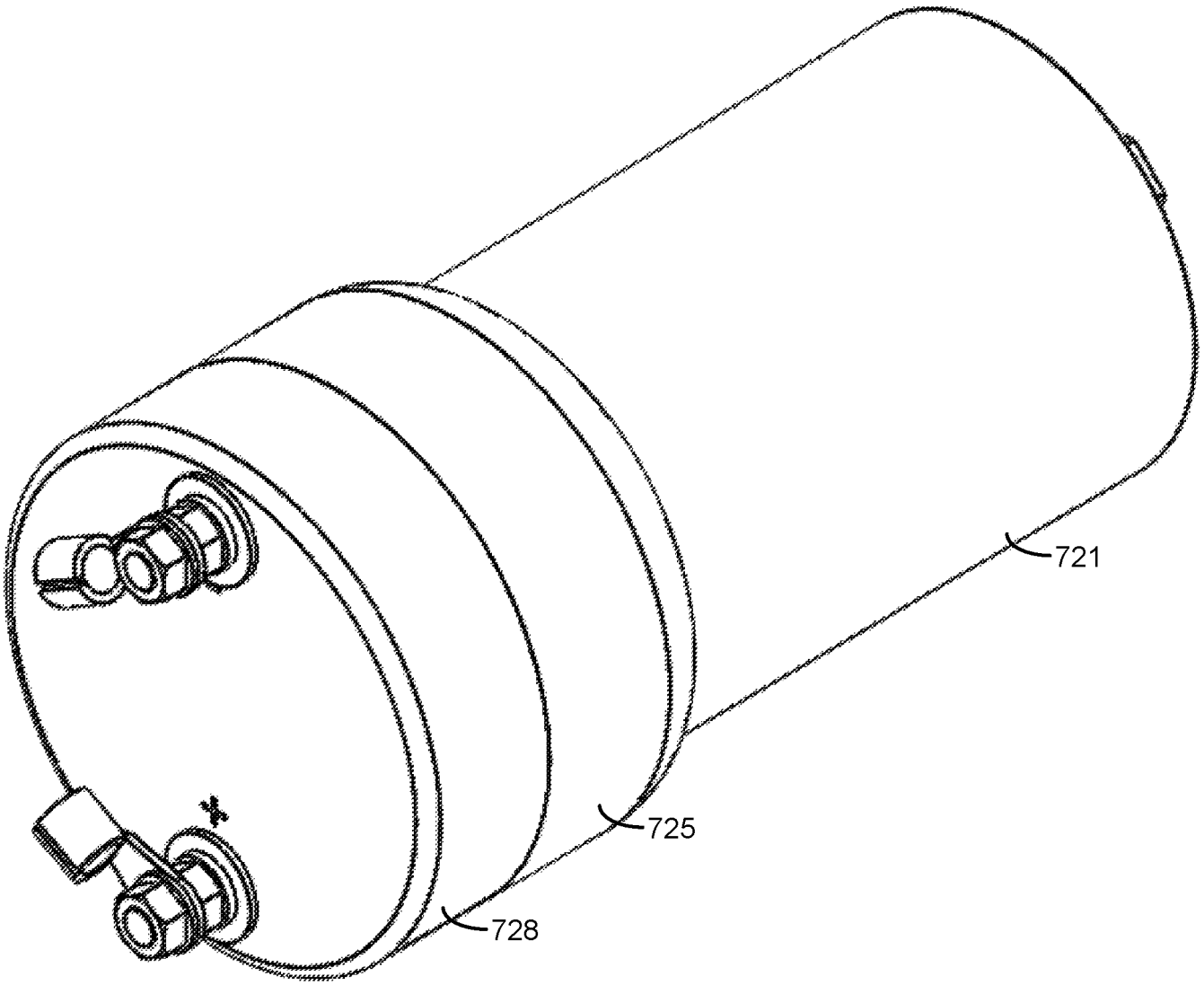
FIG. 3C is a view illustrating an assembled example integrated solid state winch control and winch motor assembly.

FIG. 3A is an exploded view illustrating an example integrated solid state winch control and winch motor assembly. Integrated assembly 700 comprises motor housing 721, brush holder 722, brush studs 723-724, heat sink 725, thermal pad 726, power board 750, control board 727, and end cover 728. Motor housing 721 contains four stator permanent magnets (stationary elements) (not shown in FIG. 3A). The armature (rotating element) is illustrated inside the motor housing 721 with the electromagnet contacts (the commutator) perpendicular to the axis of the armature. Brush holder 722 may be a plastic part that holds 4 brushes that come in contact with the commutator.

Brush stud 723 may have flexible wires attached to it from two of the four brushes. Brush stud 723 stud inserts through the heat sink (electrically isolated), through the thermal pad 726 and through the power board 750 where it has a nut installed that makes an electrical connection to the power board. Brush stud 724 may have flexible wires attached to it from two of the four brushes. Brush stud 724 inserts through the heat sink (electrically isolated), through the thermal pad 726 and through the power board 750 where it has a nut installed that makes an electrical connection to the power board.

Heat sink 725 may be an aluminum part that dissipates the heat generated on the power board. The heat conducts through the busbars mounted on the bottom side of the power board 750 and through the thermal pad 726 (which provides electrical isolation) to heat sink 750. Thermal pad 726 provides electrical isolation and a low thermal resistance between the power board 750 and the heat sink 725.

Power board 750 may be a printed circuit board (PCB). Power board 750 includes power circuitry for the contactor. Power board 750 may include power MOSFETs that drive the motor and can reverse its direction of rotation. Control board 727 may be a PCB. Control board 727 includes circuitry that controls power board 750.

End cover 728 provides a seal against water/moisture intrusion for the contactor and motor circuitry. In an embodiment, two battery studs pass through the end of end cover 728 for external connection to a battery. The IN/OUT control cable and the Energize/Indication cable pass through a side of end cover 728. The battery connections provide power to drive the winch. The IN/OUT cable goes to an IN/OUT switch that, when activated, causes the winch to let rope out or pull it in. The Energize signal of the Energize/Indication cable is used to energize the winch for use via a momentary pushbutton switch 422. The Indication signals drive an external red-green-blue LED 424 to signify the activity of the winch.

Figure 4:
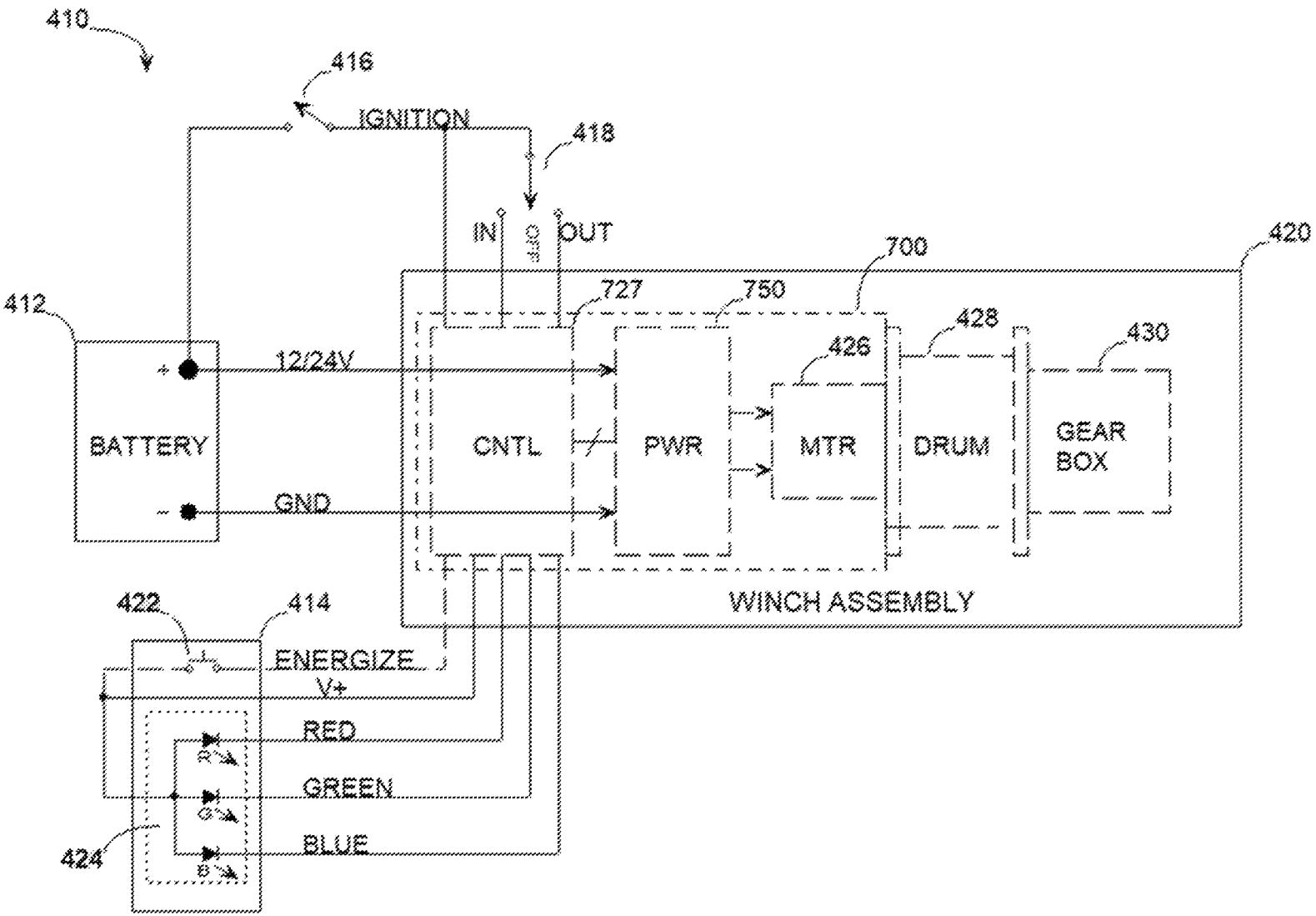
FIG. 4 is a diagram illustrating components of an example winch system having an integrated solid state winch control and winch motor assembly integrated into a winch assembly.

FIG. 4 is a diagram illustrating components of an example integrated solid state winch control and winch motor assembly 700 integrated into a winch assembly 420. Winch system 410 may be or include all or portions of assembly 700. In particular, integrated assembly 420 may correspond to, or be, at least in part, to assembly 700.

In FIG. 4, battery 412 may be the vehicle battery, which is typically a flooded, lead-acid battery. Switch 416 may be part of the vehicle's ignition switch and may be wired to enable winch operation only when the ignition switch is on. Switch 418 may be a winch control switch with a center off position and momentary positions for IN and OUT. Switch/LED assembly 414 contains an optional switch 422 to energize winch assembly 420 and LED 424 for indication. If it is desired to have the winch assembly 420 energized at all times, then the energize signal can be permanently connected to the V+ signal. Winch power board 750 may include a solid state winch controller that provides functions necessary to drive and protect winch motor 426. Winch control board 727 and power control board 750 should be within waterproof units to withstand the elements of nature.

Figure 5A:
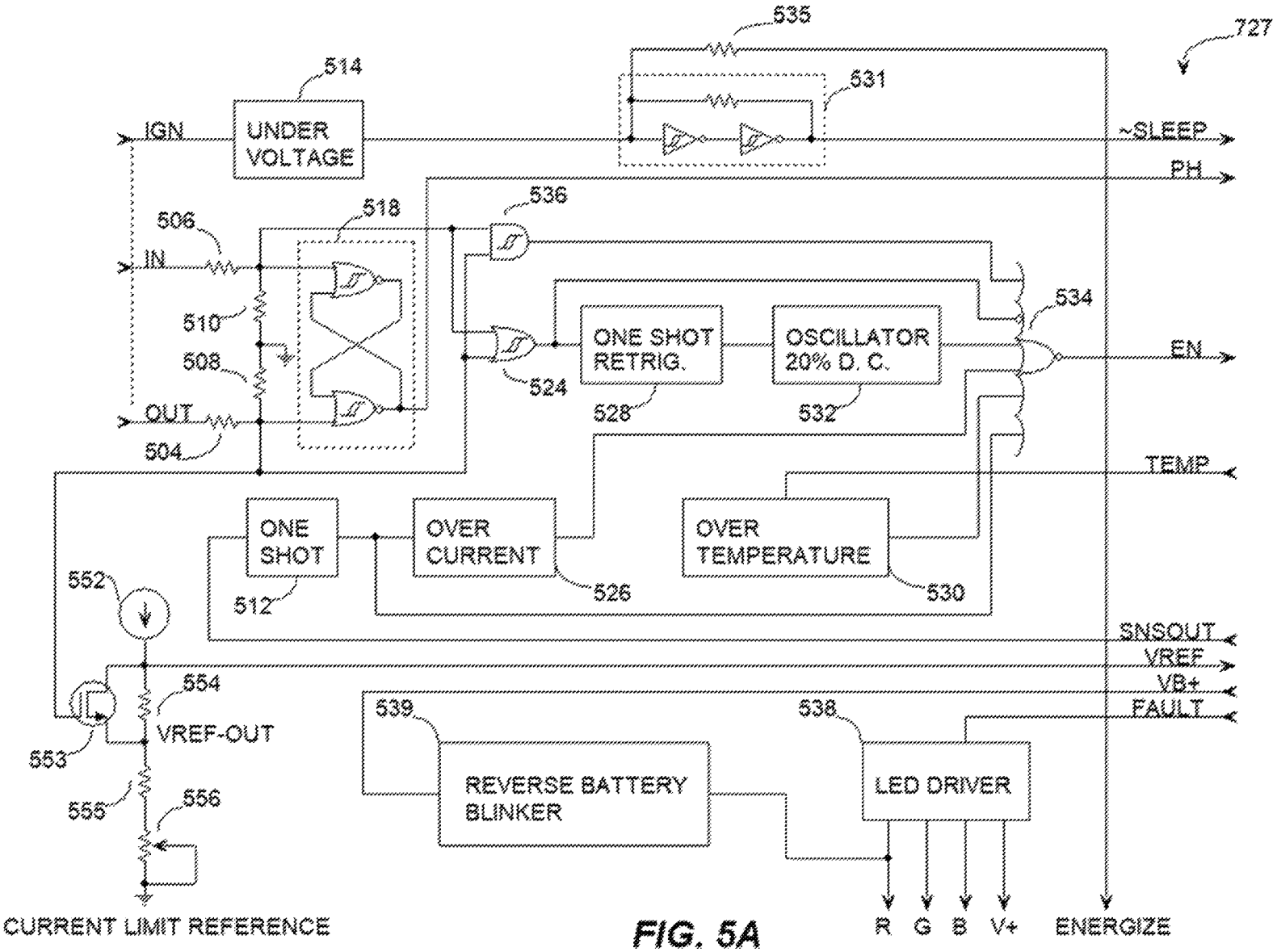
FIG. 5A is a diagram illustrating control circuitry for an example integrated solid state winch control and winch motor assembly.
Figure 5B:
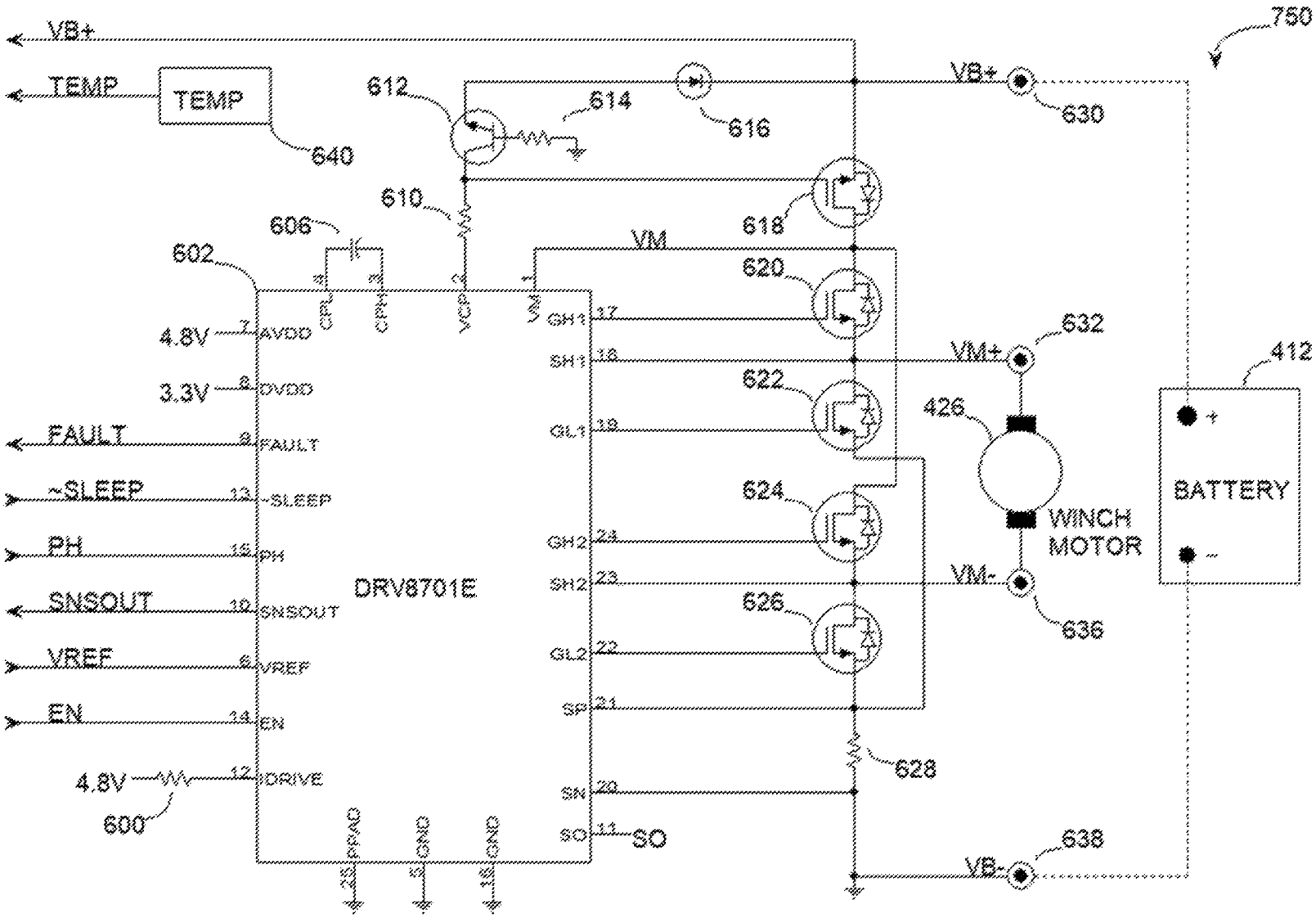
FIG. 5B is a diagram illustrating motor control circuitry for an example integrated solid state winch control and winch motor assembly.

FIGS. 5A and 5B, illustrate, for example, control board 727 and power board 750, respectively. The diagrams of FIG. 4, FIG. 5A, and FIG. 5B collectively illustrate an example winch system 410. A connector with contacts external to winch assembly 420 provides the interface for IGNITION, IN and OUT signals from switches 416 and 418. Another connector with contacts external to winch assembly 420 provides an interface for the ENERGIZE signal, and signals to control red, green, and blue light emitting diodes (LEDs) 424.

FIG. 5A illustrates an example control board (e.g., control board 422.) Under voltage 514 activates motor drive integrated circuit (IC) 602 in FIG. 5B via the SLEEP signal and lights the READY light-emitting-diode (LED) (green) part of LED 424 provided battery 412 voltage is above 8 volts. Motor drive 602 may be, for example, a DRV8701E. If the voltage is below 8 volts, or switch 416 is off, no LEDs will be lit. Resistors 508 and 510 are pull-down resistors for when IN or OUT are not selected. Resistors 504 and 506 limit the current into latch 518, AND gate 536 and OR gate 524. Latch 518 selects the phase, PH, of the drive to winch motor 426 through MOTOR DRIVE IC 602. OR gate 524 triggers one shot 528 when IN or OUT is selected. Latch 518, AND gate 536 and OR gate 524 have Schmitt trigger inputs for slow rise and fall times. Latch 518 also debounces the IN and OUT signals.

One shot 528 may have an exemplary pulse width of 650 milliseconds. Other pulse widths are contemplated. When one shot 528 is triggered, oscillator 532 begins to oscillate at, for example, 9.5 kHz with an example 20% duty cycle (percentage of low level time). The output of NOR gate 534 (having one inverted input) is high to drive winch motor 426. If the other inputs to NOR gate 534 allow oscillator 532 to determine the enable signal, EN, the signal EN will be high for 20% of its period, generating a slow start drive for winch motor 426. Each time IN or OUT is selected, the complete (e.g., 650 millisecond) one shot 528 period occurs even if one shot 528 has not previously timed out (i.e. one shot 528 may be retriggerable). This feature is especially useful when parking the hook because it allows an extended slow start.

SNSOUT is a signal from MOTOR DRIVE IC 602 that occurs when an over current event occurs on winch motor 426 which results in winch motor 426 no longer being driven and the current limit LED (blue) part of 424 will blink on and the ready LED (green) part of 424 will be turned off. SNSOUT is generated as a means of current regulation for winch motor 426 referred to as "current chopping". Current chopping is a "fixed-off-time" regulation scheme with a variable time to be on and to stay on until current chopping occurs again. Again, because power MOSFETs 620-626 are large, this off time pulse should be increased from its example 25 microseconds. One shot 512 pulse width may be, for example, 500 microseconds. One shot 512 extends the off time of winch motor 426 through an input in NOR gate 534. The response time of this solid state current limiting technique is typically less than 10 microseconds as compared to several milliseconds when electro-mechanical relays are used to drive winch motor 426, making this solid state contactor (power board 750) virtually indestructible.

Even though motor drive IC 602 and one shot 512 combine to provide current regulation for winch motor 426, the rate at which current chopping occurs is a function of how much current overload exists in winch motor 426. If current chopping is occurring continuously, over current 526 will shut down drive to winch motor 426 through an input of NOR gate 534 for a period of, for example, 10 seconds and during which time over current LED (blue) part of 424 is lit. Over current shutdown can occur, for example, in 500 milliseconds for very high, current overloads.

Over temperature 530 receives an indication of the temperature of MOSFET 626 via TEMP from temperature sensor 640 (in FIG. 5B). MOSFET 626 is on during an IN operation and at which time winch motor 426 is likely to be heavily loaded and shuts down drive to winch motor 426 when the temperature reaches, for example, 85° C. Shutdown lasts, for example, 10 seconds to allow cool down of MOSFETs 618, 620 and 626. This event lights over temperature LED (red) part of LED 424 and turns off the ready LED (green) part of LED 424. All protection shutdown modes for winch motor 426 may last sufficiently long to alert the operator that a protection feature has taken over control of winch motor 426.

LED driver 538 consists of a circuit using an LED driver IC that provides a constant current drive for each LED (red, green and blue) 424, with no more than one LED on at a time. LED (red) is used to indicate warnings. LED (green) is used to indicate the winch system 410 is energized and ready for use and LED (blue) is used to indicate current limiting.

Reverse battery blinker 539 is only active when the battery voltage polarity to winch motor 426 is reversed. This condition can be caused by having the battery installation reversed in the vehicle or the battery cable connections reversed on the winch assembly 420. Under either of these conditions the reverse battery blinker 539 causes the LED (red) part of LED 424 to blink at a frequency, for example, of 2 kHz to warn the installer that there is a battery polarity reversal and it needs immediate attention. None of the other LEDs in LED 424 will be lit during this condition.

Precision current source 552 provides the current to establish the current limit reference voltage VREF for winch motor 426 by causing appropriate voltage drops across resistors 554, 555 and variable resistor 556. The voltage drop across resistor 555 sets the current limit reference voltage VREF-OUT to yield a current limit during OUT of, for example, 80 amps. During OUT, MOSFET 553 shorts out the voltage drop across resistor 554. During IN, the voltage drop across resistor 554 plus the voltage drop across resistor 555 sets the current limit reference voltage VREF for winch motor 426, for example, 80 amps plus 120 amps=200 amps. The current limit amplifier output SO of motor drive IC 602 has a gain of 20 with an intentional output offset voltage of up to 250 millivolts. The voltage drop across variable resistor 556 is set to the same voltage as measured on current limit amplifier output SO when IN or OUT is not activated. The result is a current limit reference voltage VREF that always includes this offset voltage.

Motor drive IC 602 contains a charge pump to create charge pump voltage, VCP, which is typically 9.5 volts above winch motor supply voltage, VM, so N-channel, enhancement mode, MOSFETs 620 and 624 can be used. In an embodiment, the charge pump in motor drive IC 602 can deliver only enough current to support MOSFETs 620 and 624 that have a maximum total gate charge, Qg, of 200 nanocoulombs at 38 kHz. The timing on oscillator 532 and one shot 512 should be selected to be compatible with the chosen MOSFETs 620 and 624. (e.g., MOSFETs that have a maximum Qg of 578 nanocoulombs.) The programming resistor 600 on motor drive IC 602 for IDRIVE may be chosen, for example, to be the maximum rating of 150 milliamps for high-side MOSFETs 620 and 624 and 300 milliamps for low-side MOSFETs 622 and 626. Capacitor 606 is the charge pump capacitor. Charge pump voltage, VCP, is also used to provide gate bias voltage for MOSFET 618.

Many protection features are included in motor drive IC 602 for MOSFETs 620-626 including excessive drain-to-source voltage (an indication of excessive drain current), undervoltage for motor supply voltage, VM, undervoltage for charge pump voltage, VCP, winch motor 426 current limiting, and delays for turning high side MOSFETs 620 and 624 on only after low side MOSFETs 622 and 626, respectively, have turned off, and vice versa. When MOSFETs 620 and 626 are on, the voltage at VM+ terminal 632 is positive and the voltage at VM− terminal 636 is negative and winch motor 426 is in the rewind mode, IN. And vice versa, when MOSFETs 624 and 622 are on, the voltage at VM+ terminal 632 is negative and the voltage at VM− terminal 636 is positive and winch motor 426 is in the unwind mode, OUT. The positive voltage, VB+, from battery 412 goes through reverse-battery-protection MOSFET 618 before supplying power to motor drive IC 602. If, when installing battery 412 in the vehicle, the positive terminal of battery 412 is connected to VB− terminal 638 (ground) and the negative terminal of battery 412 is connected to the VB+ terminal 630, the reverse-battery-protection circuit comprising of diode 616, NPN transistor 612 and resistors 610 and 614 will turn MOSFET 618 off and not allow the voltage on VM terminal to be negative with respect to VB-terminal 638 and blinks LED (red) part of 424. During this event no other LEDs are lit.

Resistor 628 senses current of winch motor 426 for the purpose of over-current-protection performed by motor drive IC 602.

The Output voltage (AVDD) 4.8V, from motor drive IC 602 provides power for control board 727. Output voltage (DVDD), 3.3V, from motor drive IC 602 is used to power LED driver 538. The FAULT signal being an output of motor drive IC 602, active low during any of the many protection features built into motor drive IC 602 and recovers automatically when the fault ceases.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An electronic winch, comprising:

a winch motor to let a winch rope out and to pull the winch rope in at a plurality of speeds;

control circuitry, coupled to the winch motor and configured to, in response to receiving a first activation signal from a first momentary switch, limit current provided to the winch motor to a first current amount and control the winch motor to provide a first speed for a first electronically timed period of time after receiving the first activation signal, the control circuitry also configured to control the winch motor to provide a second speed in response to the first electronically timed period of time expiring, the control circuitry also configured to, in response to receiving a second activation signal from a second momentary switch, limit current provided to the motor to a second current amount and control the winch motor to provide the first speed for the first electronically timed period of time after receiving the second activation signal, the control circuitry also configured to control the winch motor to provide the second speed in response to the first electronically timed period of time expiring, where the first current amount and the second current amount are not equal.

2. The electronic winch of claim 1, wherein the first speed is slower than the second speed.

3. The electronic winch of claim 1, wherein the first speed is repeated for the first period of time in response to receiving a third activation signal from the first momentary switch.

4. The electronic winch of claim 1, wherein a first voltage is modulated to control the winch motor to provide the first speed.

5. The electronic winch of claim 4, wherein the first voltage is pulse width modulated to control the winch motor to provide the first speed.

6. The electronic winch of claim 5, wherein the first voltage is applied to the winch motor to provide the second speed.

7. The electronic winch of claim 6, wherein the control circuitry also configured to control the winch motor to provide a third speed in response to an indicator that there is no load on the winch motor.

8. The electronic winch of claim 7, wherein a second voltage is applied to the winch motor to provide the third speed.

9. An electronic winch, comprising:

a winch motor to let a winch rope out and to pull the winch rope in at a plurality of speeds;

control circuitry, coupled to the winch motor and configured to, in response to receiving an energize signal and after receiving a first activation signal from a first momentary switch, limit current provided to the winch motor to a first current amount and control a first torque of the winch motor to provide a first speed for a first electronically timed period of time after receiving the first activation signal, the control circuitry also configured to control a second torque of the winch motor to provide a second speed in response to the first electronically timed period of time expiring, the control circuitry also to, after receiving a second activation signal from a second momentary switch, limit current provided to the winch motor to a second current amount and control a second torque of the winch motor to provide the first speed for the first electronically timed period of time after receiving the second activation signal, where the first current amount and the second current amount are not equal; and, a housing enclosing the winch motor and the control circuitry.

10. The electronic winch of claim 9, further comprising an energize switch that is required to be pushed before the electronic winch can be operated.

11. The electronic winch of claim 9, wherein the first speed is slower than the second speed.

12. The electronic winch of claim 9, wherein the first speed is repeated for the first period of time in response to receiving a third activation signal from the first momentary switch.

13. The electronic winch of claim 9, wherein a first voltage is modulated to control the first torque of the winch motor to provide the first speed.

14. The electronic winch of claim 13, wherein the first voltage is pulse width modulated to control the first torque of the winch motor to provide the first speed.

15. The electronic winch of claim 14, wherein the first voltage is applied to the winch motor to provide the second speed.

16. The electronic winch of claim 15, wherein the control circuitry also configured to control the winch motor to provide a third speed in response to an indicator that there is no load on the winch motor.

17. An integrated winch motor assembly, comprising:

a winch motor to let a winch rope out and to pull the winch rope in at a plurality of speeds;

winch motor power control circuitry coupled to the winch motor;

control circuitry coupled to control the motor power control circuitry and configured to, in response to receiving a first activation signal from a first momentary switch, limit current provided to the winch motor to a first current amount and control the motor power control circuitry to control the winch motor to provide a first winch load rating for a first electronically timed period of time after receiving the first activation signal, the control circuitry also configured to control the power control circuitry to control the winch motor to provide a second winch load rating in response to the first electronically timed period of time expiring, the control circuitry also to, after receiving a second activation signal from a second momentary switch, limit current provided to the winch motor to a second current amount and control the power control circuitry to control the winch motor to provide the first winch load rating to provide the first speed for the first electronically timed period of time after receiving the second activation signal, where the first current amount and the second current amount are not equal; and, a housing, comprising at least two parts, configured to protect the winch motor, the winch motor control circuitry, and the control circuitry from water intrusion.

18. The electronic winch of claim 17, wherein the first winch load rating is more than the second winch load rating.

19. The electronic winch of claim 17, wherein the first winch load rating is repeated for the first period of time in response to receiving a third activation signal from the first momentary switch.

20. The electronic winch of claim 17, wherein an armature current of the winch motor is modulated to control the winch motor to provide the first winch load rating.

* * * * *